US006256933B1

(12) United States Patent
Kuhns

(10) Patent No.: US 6,256,933 B1
(45) Date of Patent: Jul. 10, 2001

(54) ROOF VALLEY WATER DISTRIBUTOR

(76) Inventor: Richard L. Kuhns, 210 Broad St., Red Bank, NJ (US) 07701

( * ) Notice: Subject to any disclaimer, the term of this patent is extended or adjusted under 35 U.S.C. 154(b) by 0 days.

(21) Appl. No.: 09/444,322

(22) Filed: Nov. 19, 1999

Related U.S. Application Data

(63) Continuation-in-part of application No. 08/925,690, filed on Sep. 9, 1997, now Pat. No. 6,009,672.

(51) Int. Cl.[7] ..... E04D 13/00
(52) U.S. Cl. ..... 52/13; 52/11; 52/15; 52/97
(58) Field of Search ..... 52/11, 12, 13, 52/15, 24, 97

(56) References Cited

U.S. PATENT DOCUMENTS

| | | | | |
|---|---|---|---|---|
| 358,936 | * | 3/1887 | Krueger | 52/15 |
| 373,129 | | 11/1887 | Carroll . | |
| 618,074 | * | 1/1899 | Dyer | 52/13 X |
| 853,897 | * | 5/1907 | Porter | 52/24 |
| 1,986,383 | * | 1/1935 | Usinger | 52/13 X |
| 2,120,395 | | 6/1938 | Dean . | |
| 2,129,833 | * | 9/1938 | Fradette | 52/24 |
| 2,537,243 | | 1/1951 | Swartz . | |
| 3,579,930 | * | 5/1971 | Murphy | 52/24 |
| 4,594,819 | * | 6/1986 | Kneisel | 52/13 X |
| 5,205,088 | * | 4/1993 | Mueller | 52/24 |
| 5,271,191 | | 12/1993 | Vahamaki . | |
| 5,333,417 | | 8/1994 | Demartini . | |
| 5,333,419 | | 8/1994 | Hickner . | |
| 5,383,310 | | 1/1995 | Sapia . | |
| 5,664,374 | * | 9/1997 | Lee | 52/24 |
| 5,673,520 | * | 10/1997 | Yannucci, II | 52/24 X |
| 5,675,939 | * | 10/1997 | Hickner | 52/13 X |
| 6,076,310 | * | 6/2000 | Kim | 52/97 |

* cited by examiner

*Primary Examiner*—Beth A. Stephan
*Assistant Examiner*—Brian E. Glessner
(74) *Attorney, Agent, or Firm*—Thomason, Moser & Patterson, LLP

(57) ABSTRACT

A water distributor for directing water from roofing configurations that form a roof valley to rain gutters is disclosed. The device directs the water traveling down the roof valley into the rain gutters without collecting debris or becoming clogged with leaves or twigs that may interfere with its function.

18 Claims, 10 Drawing Sheets

ROOF VALLEY WATER DISTRIBUTOR

This application is a continuation in part of U.S. patent application Ser. No. 08/925,690 filed Sep. 09, 1997, now U.S. Pat. No. 6,009,672 which is hereby incorporated by reference in its entirety.

The invention relates to a water distributor for use with existing rain guttering and roofing. More particularly, the invention relates to a water distributor that is positioned within an inside valley of a roof to direct water in a more uniform manner to the guttering.

BACKGROUND OF THE INVENTION

To eliminate clogging of rain gutters by debris, e.g., leaves, various rain gutter covers have been designed to channel water into a rain gutter, while, at the same time, keeping the debris from entering the rain gutter. One such rain gutter cover is disclosed in U.S. Pat. No. 5,216,851 issued Jun. 8, 1993, herein incorporated by reference. Such rain gutter covers function through water adhesion principles that channel water into the gutter via a plurality of apertures formed in the rain gutter cover. These apertures direct the water into the rain gutter while debris of sufficient size is excluded from entering the rain gutter. Typically, such rain gutter covers are attached between a roofline and a lip of the rain gutter along the entire length of the rain gutter.

However, two portions of a roof may meet at an angle (typically, 90 degrees) to form what is known as an inside corner or inside valley. In principle, water flowing along an inside valley flows onto the top flat portion of a gutter cover following a path to the collector portion where, through principles of surface adhesion, the water is delivered into the rain gutter as the debris carried by the water is jettisoned off of the gutter cover. However, the amount of water flowing from an inside valley may exceed the gutter cover's ability to collect the water, thereby permitting much of the water to overflow the gutter cover and to fall onto the ground resulting in soil erosion, basement leakage and so on.

In an attempt to redirect the rain water from the inside valley to a larger cross-section of gutter covers, vertical deflectors or fence-like devices have been installed on the gutter covers. These fence-like devices extend usually 1½ inches to 3 inches in height and are positioned to interrupt the flow of water before it reaches the gutter covers, thereby diverting the water laterally across the roofing or the horizontal portion of the gutter covers. In essence, the fence-like devices spread the large quantity of water within the inside valley across the roof. Unfortunately, tree debris, twigs, leaves, seeds, and so on accumulate behind the fence-like device, thereby reducing its effectiveness in diverting the rain water. Additionally, debris collecting behind the fence-like device contributes to the deterioration of the roofing material itself. To keep the fence-like device functioning, frequent cleaning is required, which is cumbersome, dangerous and contrary to the intended function of the gutter covers, i.e., keeping the rain gutters maintenance-free.

Therefore, there is a need in the art for a maintenance-free water collection device that functions within an inside valley of the roof without collecting debris.

SUMMARY OF THE INVENTION

The present invention overcomes the disadvantages associated with the prior art. Specifically, the present invention is a water distributor for diverting water from a roof valley into a rain gutter. The device provides the additional advantage of distributing rain water without the device collecting tree debris or becoming clogged with leaves or twigs that may interfere with its function.

One embodiment of the invention comprises a water distributor having a substantially triangular top surface bounded by a first edge, a second edge and a bowed edge. At least one flange is coupled to said first edge or said second edge. The triangular top surface spreads rain water flowing down the roof valley across the top surface, thus distributing the rain water into a rain gutter or a gutter protector.

Another embodiment of the invention comprises a water distributor having a top portion fastened to a first and a second rain gutter which meet beneath a roof valley. The top portion transitions into a vertical section that has at least one aperture. A member is coupled between the vertical section and the respective rain gutters. Rain water entering the water distributor from the roof valley flows onto the member and into the rain gutters.

Another embodiment of the invention comprises an apparatus for directing water from a first roof surface and a second roof surface to a rain gutter. Rain water from the first roof surface is channeled though a leader having a water distributor onto the second roof surface. The water distributor comprises an end for coupling to the leader and a discharge section having a plurality of holes. When rain water passes through the discharge section, a portion of the rain water diverted through the plurality of holes and is distributed across the second roof surface. The distributed water is then collected by the rain gutter generally without overflowing.

BRIEF DESCRIPTION OF THE DRAWINGS

The teachings of the present invention can be readily understood by considering the following detailed description in conjunction with the accompanying drawing, in which.

To facilitate understanding, identical reference numerals have been used, where possible, to designate identical elements that are common to the figures.

DETAILED DESCRIPTION

In accordance with the present invention, a rain water collector is provided which can be installed in existing roof valley configurations in conjunction with existing guttering with or without gutter covers. The present water collector is installed in a manner that does not require fastening devices to be applied to the roofing materials. Hence, it is easily installed generally by a single, unskilled person, and it is easily removed and replaced without damaging the roofing.

Figure 1:
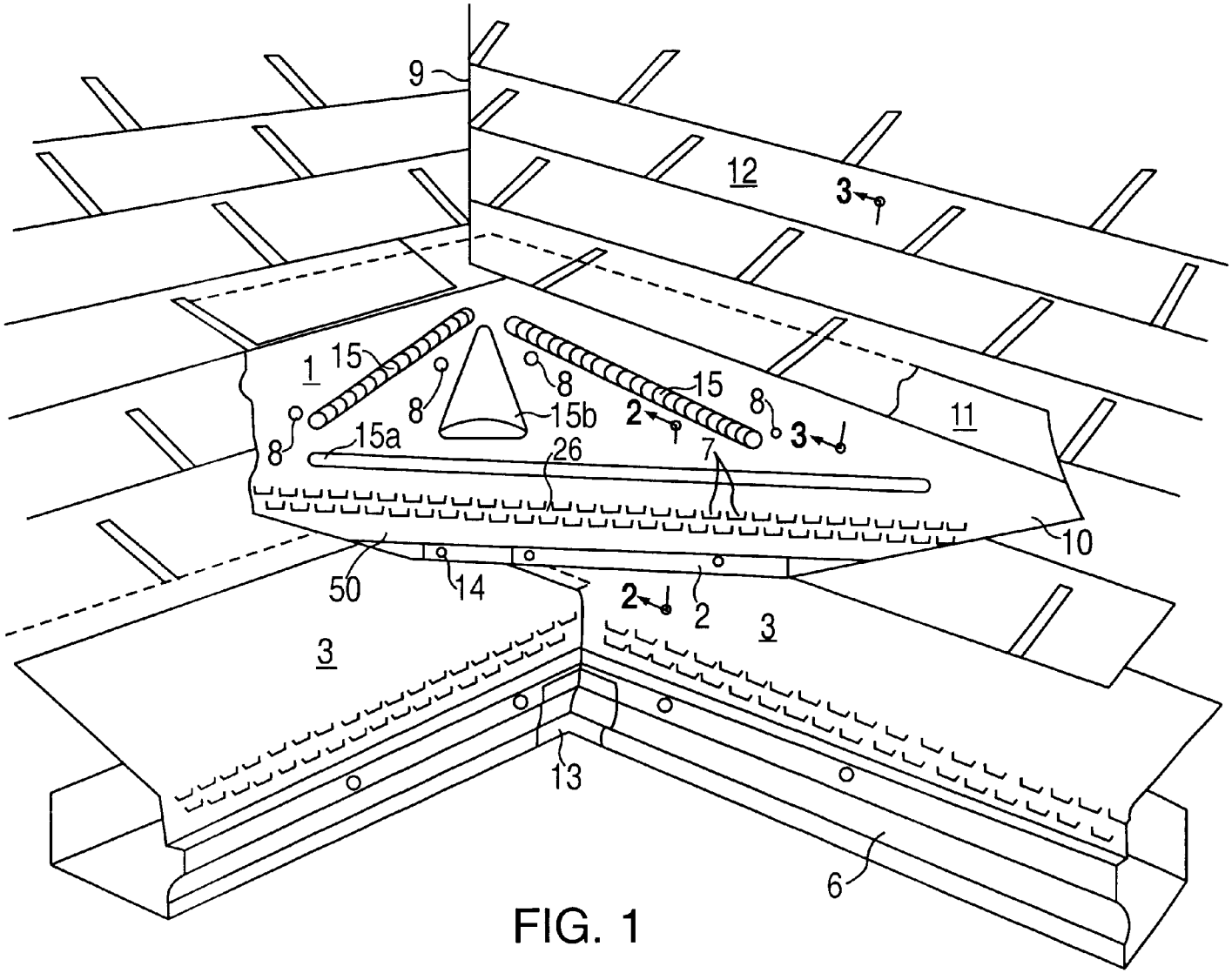
FIG. 1 is a perspective view of an embodiment of the present water collector.
Figure 2:
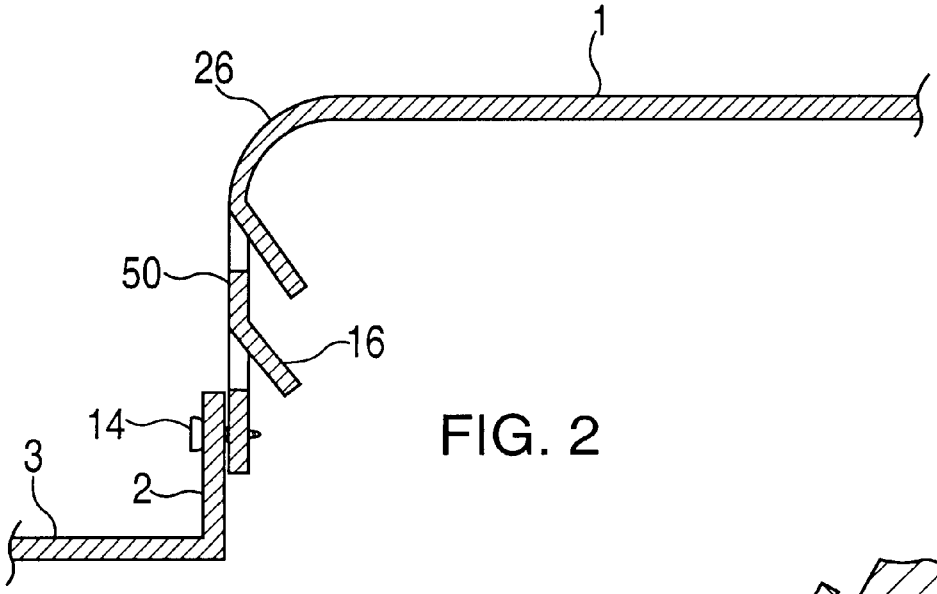
FIG. 2 is a sectional view of the embodiment of the water collector of FIG. 1 taken along line 2—2 of FIG. 1.
Figure 3:
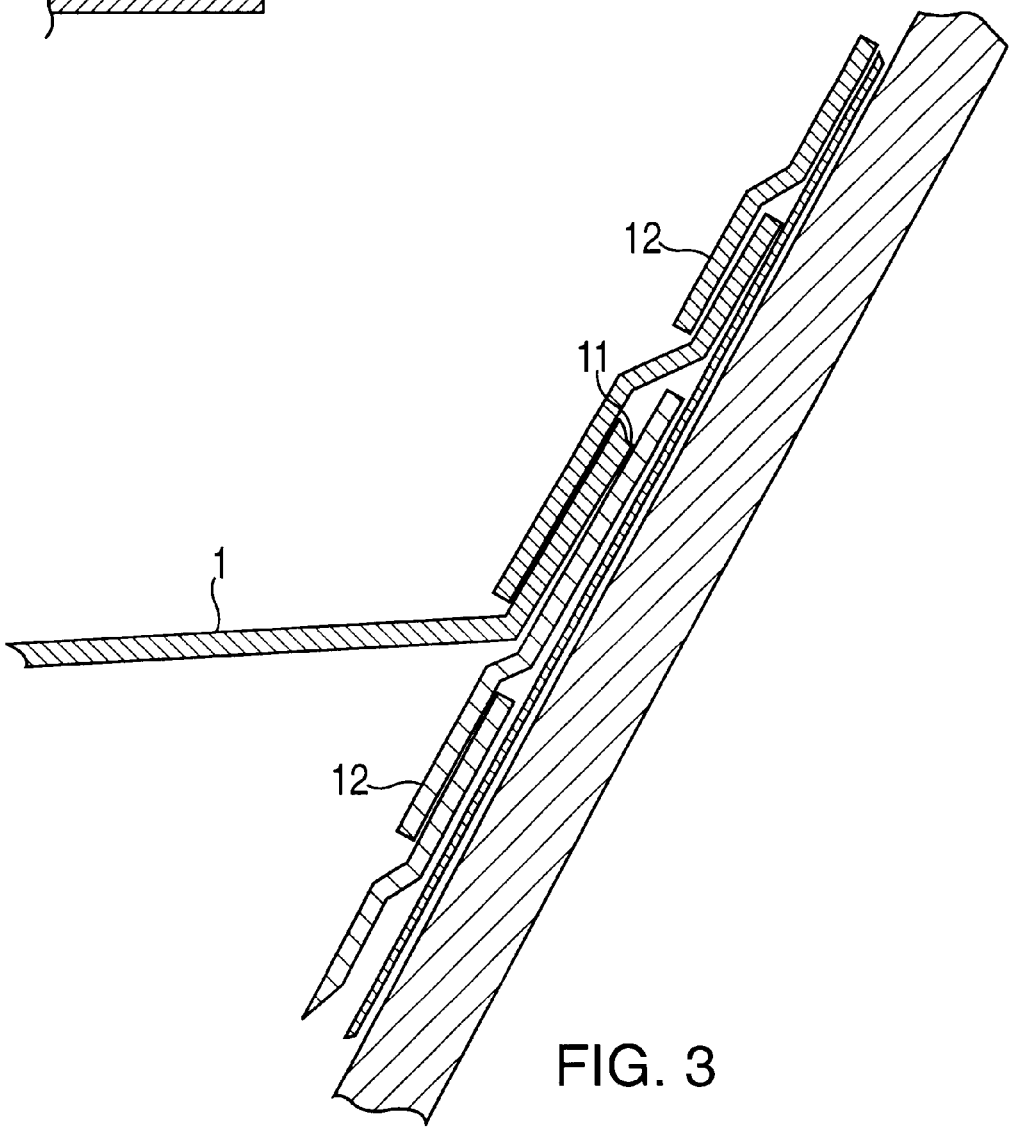
FIG. 3 is a sectional view of the embodiment of the water collector of FIG. 1 taken along line 3—3 of FIG. 1.

Referring to FIGS. 1–3, a rain water collector 10 is provided for an inside valley roofing configuration created by two intersecting rooflines 9. Such intersecting rooflines lead to a configuration of guttering connected at an angle, e.g., a right angle (at point 13). However, it should be understood that the present water collector can be implemented to accommodate a roofing juncture of any angles.

The water collector 10 has a closed-top portion 1 having a substantially triangular shape and a front portion 50. In the preferred embodiment, an arcuate front portion 26 is disposed between top portion 1 and front portion 50. Although the present invention is described below with an arcuate front portion 26, it should be understood that the present invention can be modified and implemented without the arcuate front portion 26.

More specifically, the arcuate front portion 26 extends from the top portion into a vertically disposed front portion 50. The front portion 50 may have a plurality of apertures 7 to direct rain water into a rain gutter. However, if a rain gutter cover 3 is available, vertically disposed front portion 50 can be attached along its bottom edge to a flange 2 of the rain gutter cover 3. Water collector 10 is constructed of a unitary sheet of constructed metal such as aluminum, aluminum copper alloy, vinyl or other weather resistant plastic. In one illustrative example, the unitary sheet has a length of approximately three (3) feet and a width of between 8 and 20 inches.

Although the present invention is implemented as a unitary sheet, those skilled in the art will realized that the present invention can be implemented having more than one sheet of material. Furthermore, it should be understood that the size (including the angles between the various portions of the water collector) of the present water collector can be adjusted to accommodate the dimension of a particular roof valley. For example, the front portion 50 does not have to form a right angle with respect to the top portion 1, i.e., these portions are not limited to a horizontal or a vertical configuration. Both portions can be implemented with a slope or pitch with respect to a horizontal or vertical axis.

The top portion 1 is installed such that the front arcuate portion 26 is substantially level (e.g., horizontal) and the top portion 1 is slightly pitched (e.g., 1 to 15 degrees) away from the valley. Such pitch enables water to drain toward the front arcuate portion 26 from an optional rear flap 11 extending from the top portion 1 at an angle that matches the slope of roofing 12. Rear flap 11 is optional, since it is possible to fabricate the water collector such that the top portion 1 is pitched at an angle that matches the slope of roofing 12, thereby allowing a portion of the top portion 1 to be directly inserted between the roofing material without the need of a rear flap. However, if the slope of the roofing 12 is particularly sharp, the angled rear flap allows the top portion 1 to be pitched slightly, i.e., having a less inclined slope than the roofing, thereby allowing the rain water to spread out as it travels across the top portion 1. Therefore, it is generally preferred to incorporate an angled rear flap on the water collector for roofing that has a sharp slope.

To install the water collector 10, flap 11 is slid between the roofing material such as roof shingles, to cause the water collector 10 to be stationary with respect to the roofing as shown in FIG. 3. To complete the installation, the bottom portion of vertically disposed front portion 50 is fastened with screws, rivets or clips 14 to the flange 2 of the top flat portion of gutter cover 3 as shown in FIG. 2. In the event that a gutter cover 3 is not used, the bottom portion of vertically disposed front portion 50 can be attached directly to the rain gutter 6.

The top portion 1 is also provided with longitudinal ridges or weirs 15 extending approximately ⅛ inches to ½ inches in height for spreading water to the edges of the collector adjacent to the roofing. The purpose of these ridges is to distribute the rain over a greater surface, so that the rain can be directed into the rain gutter at different points. Although a set of ridges 15 is shown in FIG. 1, those skilled in the art will realize after considering this specification that ridges of different quantity, shape and size can be employed on different locations on the top portion 1 to achieve the same effect.

For example, in an alternate embodiment, a single ridge 15*a* which is parallel to the front arcuate portion 26, may extend substantially across the entire width of the water collector. In yet another embodiment, a single ridge 15*b* which starts near the juncture of the rooflines, may extend horizontally and vertically toward the arcuate portion 26. This ridge 15*b* may have a dome like shape.

The vertical front portion 50 may contain one or more rows of a plurality of apertures 7, where each aperture contains a flap 16 connected to the top of the aperture, such that the flap 16 extends inwardly toward the rain gutter. These apertures can be formed integrally with the substantially vertical front portion 50 by stamping, piercing, or die cutting the flaps from the front portion and by bending the flaps inwardly.

Due to the principle of surface adhesion, rain traversing over the top of the aperture 7 is drawn into the aperture via the flap 16. The configuration of these rows of apertures is such that all generally vertical paths of rain flow downwardly across the vertical front portion 50, are interrupted by at least one of these apertures 7. The size of these apertures (approximately ½ inch by ¾ inch) should be sufficiently small so as to generally prevent leaves and other debris from entering the rain gutter. Those skilled in the art will realize after considering this specification that apertures of different quantity (including the number of rows), shape and size can be employed to achieve the same water channeling effect.

Referring to FIG. 1, the top portion 1 can also be optionally provided with openings 8 for the purpose of directing rain into the rain gutter. Again, the size of these openings (approximately 1/16 inch to ¼ inch in diameter) should be sufficiently small so as to generally prevent leaves and other debris from entering the rain gutter. These openings 8 are typically distributed over the surface of top portion 1 to enhance the guidance of rain water into the rain gutter. Since water collector 10 is positioned directly over both a portion of the roofing 12 and the rain gutter 6, water entering these openings 8 is either directed to the rain gutter 6 directly or to a different portion of the roofing 12 underlying the water collector 10. In both cases, the desired effect of spreading and directing rain water from the inside valley of a roof into a rain gutter 6 is accomplished.

Those skilled in the art after considering this specification will realize that this water collector 10 can be modified to adopt to valley configurations adjacent to non-connecting guttering at right angles as well as valleys having no roof edge which is adjacent to guttering, or valleys created by a dormer leading to straight guttering. Those skilled in the art after considering this specification will also realize that this water collector 10 can be modified to work with all types of roofing, including but not limited to, wood shingles, metal, slate, tile, and so on. In fact, the present water collector 10 can be used with open unprotected guttering.

Additionally, FIG. 4 through FIG. 15 illustrate various alternate embodiments of the present invention having a water distributor that is used in conjunction with roof valleys to be installed on new or existing rain guttering. Generally, the water distributor, described in a number of illustrative embodiments detailed below, spreads rain water flowing down a roof valley across the roof surface so that the rain water may be collected by the rain gutter without overflowing. The utility of the water distributor, discussed below, provides a method distributing rain water into the rain gutter without becoming clogged with leaves and other debris. Additionally, the water distributor is easily installed by one unskilled person. Of course, one skilled in the art will be readily able to devise additional variants of the water distributor through use of the teachings disclosed herein.

Figures 4, 9:
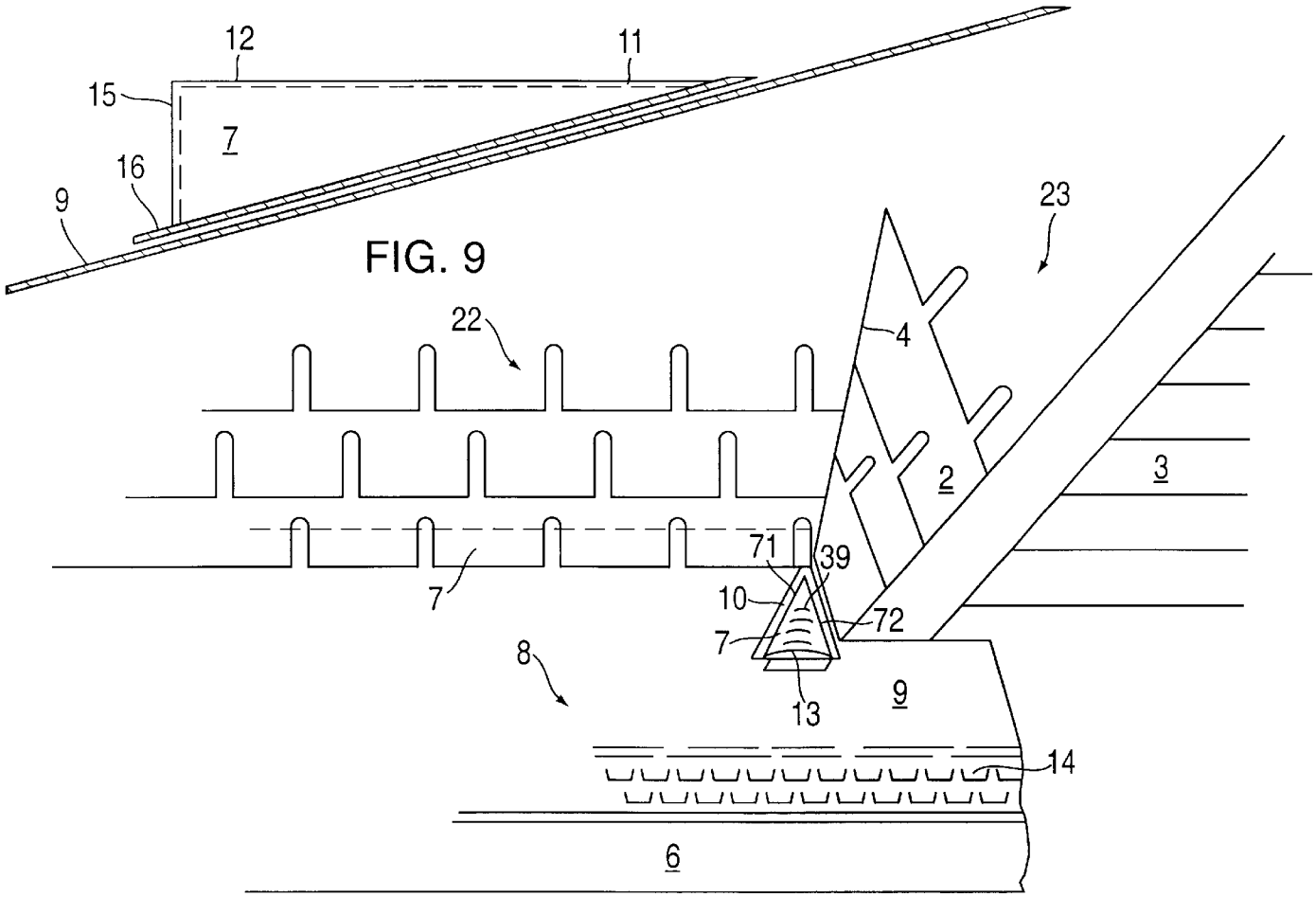
FIG. 4 is a perspective view of another embodiment of the water distributor mounted on an existing gutter cover (improved rain gutter)
FIG. 9 is a side view of the water distributor of FIG. 5.
Figure 7:
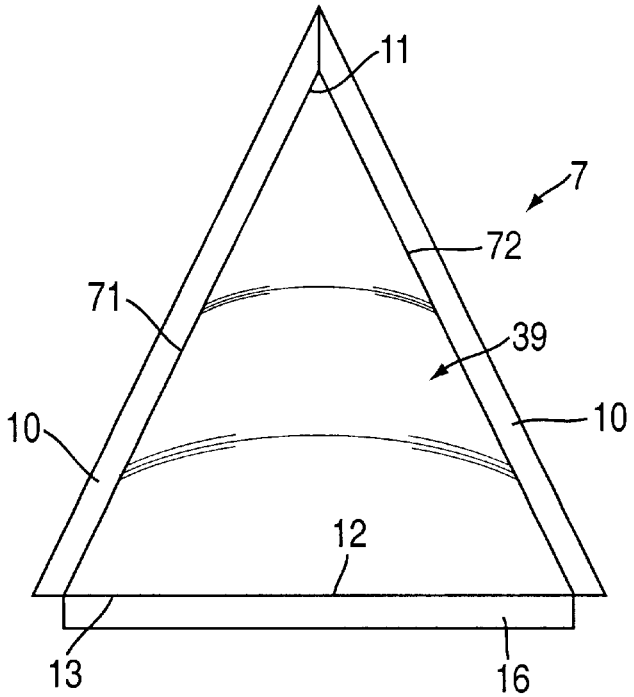
FIG. 7 is a top view of the water distributor of FIG. 4.
Figure 5:
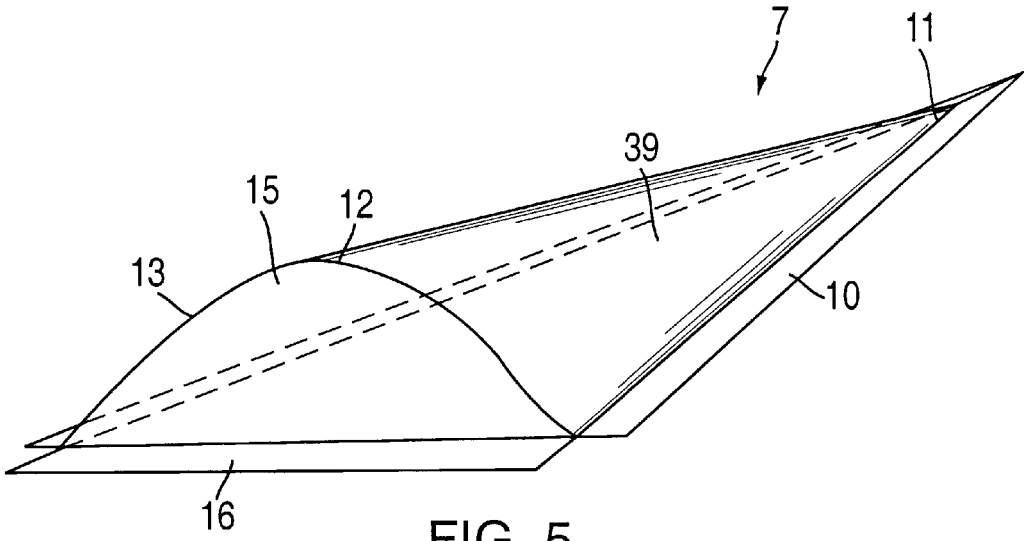
FIG. 5 is a perspective view of the water distributor of FIG. 4.

FIG. 4 is a perspective view of an alternate embodiment of the water distributor invention. In FIG. 4, roofing shingles 1 covering a first sloped roof 22 of a building, such as a dwelling house or other structure, are attached to the roof 22 parallel and adjacent to a rain gutter 6. The rain gutter 6 is optionally fitted with a gutter cover 8. Roofing shingles 2 covering a second roof 23 are mounted on a gable portion 3 of the dwelling house and are generally perpendicular to the rain gutter 6. The roofing shingles 1 and 2 meet to form a roof valley 4 along the intersection of the roofs 22 and 23. Water collected from roofs 22 and 23 flows down the roof valley 4 to the gutter cover 8 mounted on the rain gutter 6.

In accordance with the present invention, as shown in FIG. 4 through FIG. 9, a water distributor 7 is attached by a fastening means, such as screws or rivets, to a top portion 9 of a rain gutter cover 8 affixed to a rain gutter 6. The water distributor 7 may be alternately attached to a roof valley 4. Rain water from the roofing shingles 1 and 2 flows down the roof valley 4 onto the top portion 9 of gutter cover 8 along with any tree debris such as blossoms and leaves.

The water distributor 7 has a substantially triangular top surface 39 bounded by a first edge 71, a second edge 72 and a bowed edge 13. The first edge 71 and the second edge 72 are generally straight and have an equal length. Alternately, the first edge 71 and the second edge 72 may have unequal lengths. At least one flange is coupled to the first edge 71 or the second edge 72. Preferably, a flange 10 is present on both the first edge 71 and the second edge 72. Alternately, the flange 10 may be replaced by one or more tabs. The flange 10 is fastened to the roof or a top 9 of the gutter cover 8, thus securing the water distributor 7. Generally, the water distributor 7 is fabricated from one unitary sheet of metal or plastic, although multiple piece construction may be utilized. The reader should note that the flange 10 may be incorporated within the top surface 39 when the top surface 39 is fastened directly to the top 9 of the gutter cover 8 with a screw, nail, rivet or other type of fastener.

The bowed edge 13 is generally curved in form, having a high point 12 that is generally centered along the bowed edge 13. The two straight edges (71 and 72) and the bowed edge 13 generally cause the top surface 39 to be curved (domed shaped).

A rear portion 11 of the top surface 39 is positioned at the intersection of the first and second edges 71 and 72. The rear portion 11 is attached on top portion 9 of gutter cover 8 at the point of highest concentration of water flowing from the roof valley 4. The bowed edge 13 is generally (although not necessarily) installed parallel to the rain gutter 6. As the rain water and other debris flow onto the water distributor 7, the water and other debris are spread out laterally across water distributor 7 as the flow moves closer to the highest point 12. The flow of water from the roof valley 4 thus is evenly distributed into a wider flow across the water distributor 7. The resulting wider flow is more readily accommodated by the gutter cover 8. By spreading out the volume of water traveling down the roof valley 4, apertures 14 in the gutter cover 8 are able to effectively collect most of the water while rejecting the debris to the ground. Alternately, the water distributors 7 may be affixed directly to the roof valley 4.

An optional front portion 15 covers the front of the water distributor 7 and is fastened to the top 9 of the gutter cover 8 with fasteners such as screws or rivets through a flange 16. The water distributor 7 can be made integrally with the front portion 15 from one unitary sheet of metal or plastic. Alternate forms of plastic fabrication also result in one piece construction. Alternately, the front portion 15 and water distributor 7 can be fabricated from a plurality of separate pieces of metal or plastic (such as aluminum, aluminum copper alloy, coated steel, vinyl or other weather resistant plastic) joined together by methods known to those in the industry. Rather than the front portion 15 being joined at a right angle to the bowed edge 13 of the water distributor 7, an arcuate surface (not shown) can be used to join them together. Likewise, apertures, (not shown) to collect water can be located in the front portion 15 of water distributor 7 if the water distributor 7 is affixed over the rain gutter 6.

Figure 8:
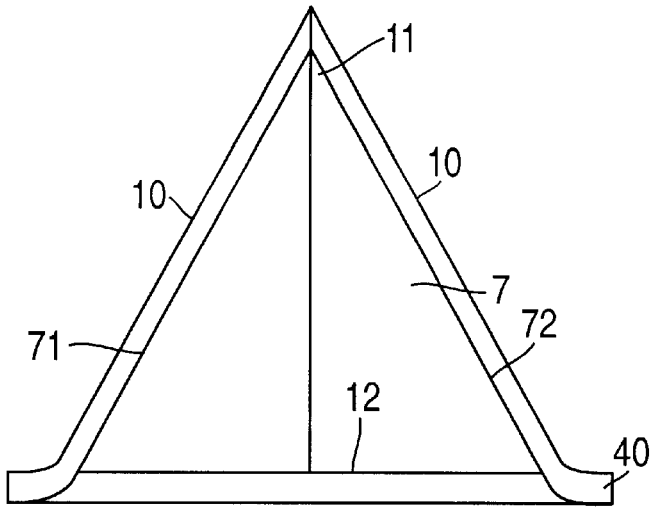
FIG. 8 is a top view of the water distributor of FIG. 6.
Figure 6:
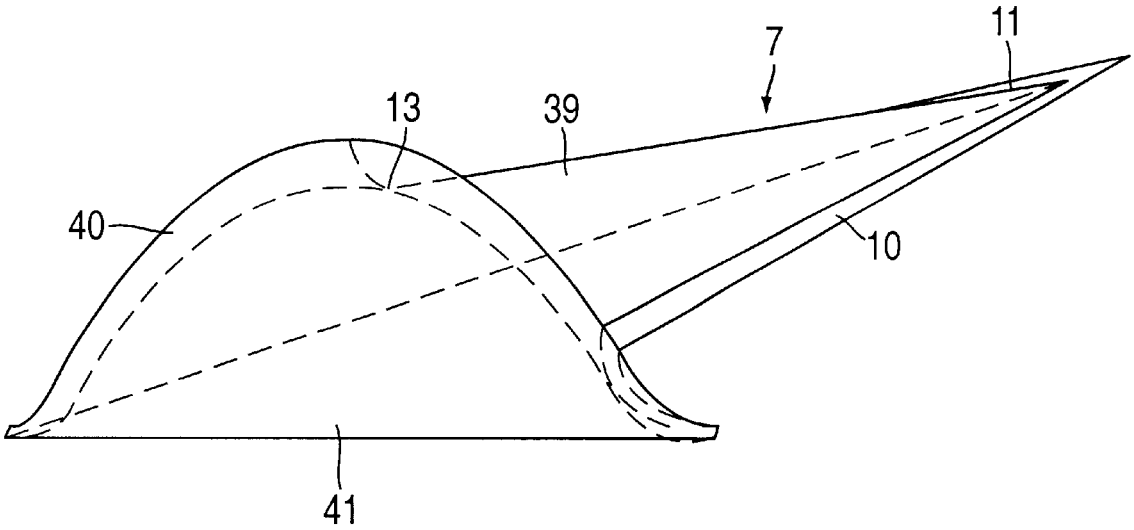
FIG. 6 is a perspective view of another embodiment of the water distributor.

Another embodiment depicted in FIG. 6 and FIG. 8 illustrates a water distributor 7 wherein the bowed edge 13 terminates in a lip 40 flared at an angle between 0 and 135 degrees from the top surface 39 of the water distributor 7. In one embodiment, the lip 40 is flared between 60 and 120 degrees. The lip 40 interrupts the flow of water over the water distributor 7, directing a greater portion of the flow toward the first and second edges 71 and 72. Those skilled in the art will recognize that the front portion 15 (of FIG. 5) can be extended beyond the bowed edge 13 in a manner to incorporate the lip 40 into a front panel 41.

Figure 10:
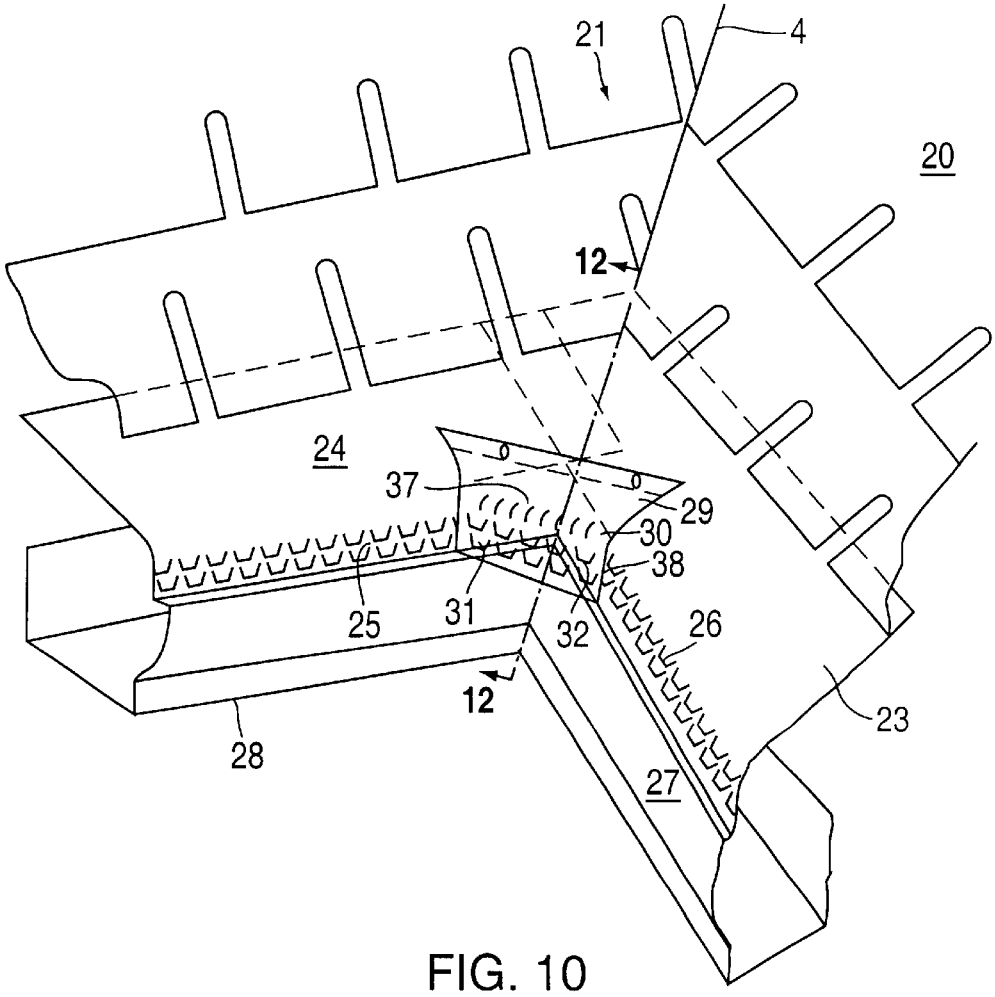
FIG. 10 is a perspective front-top view of another water distributor incorporated at the intersection area of two perpendicular gutter covers and roofing.
Figure 11:
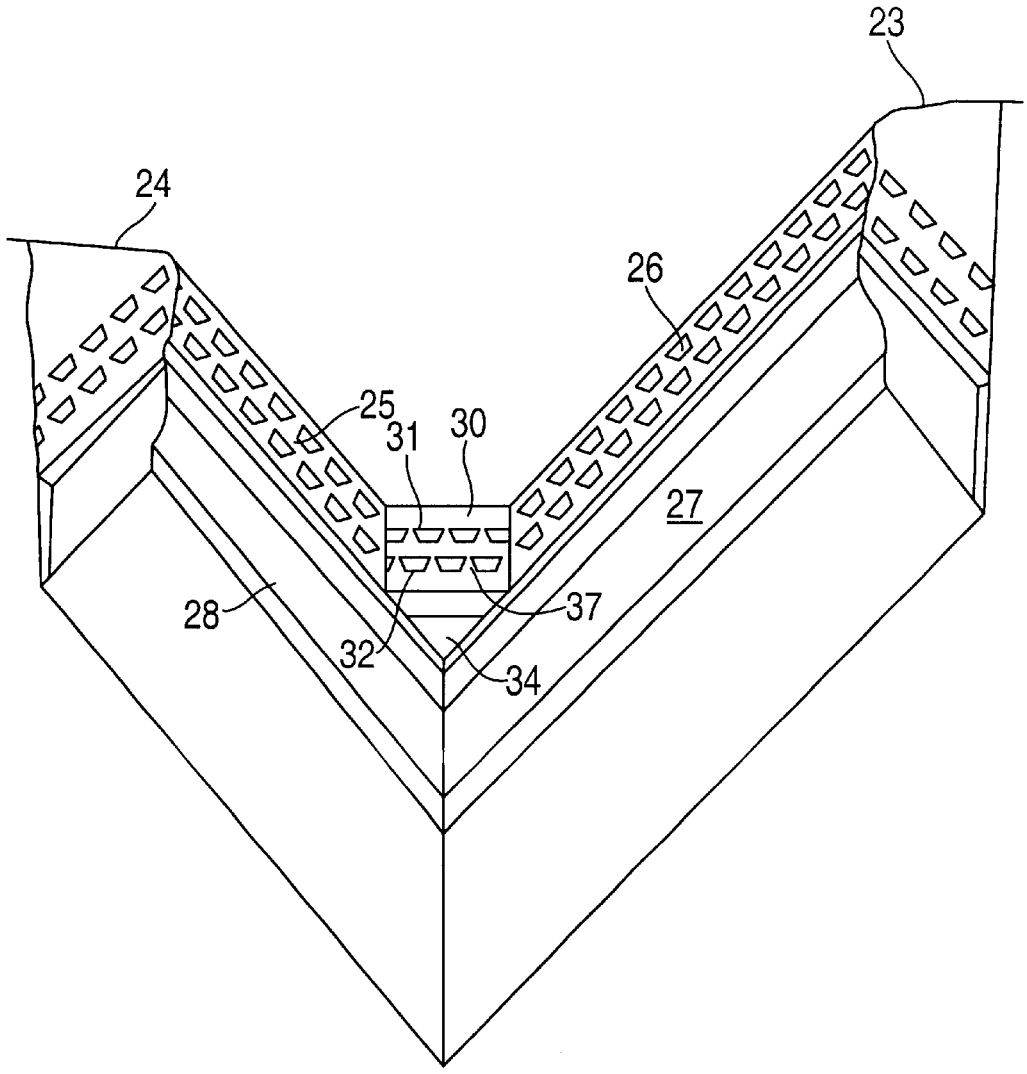
FIG. 11 is a perspective front-bottom view of the water distributor of FIG. 10.
Figure 12:
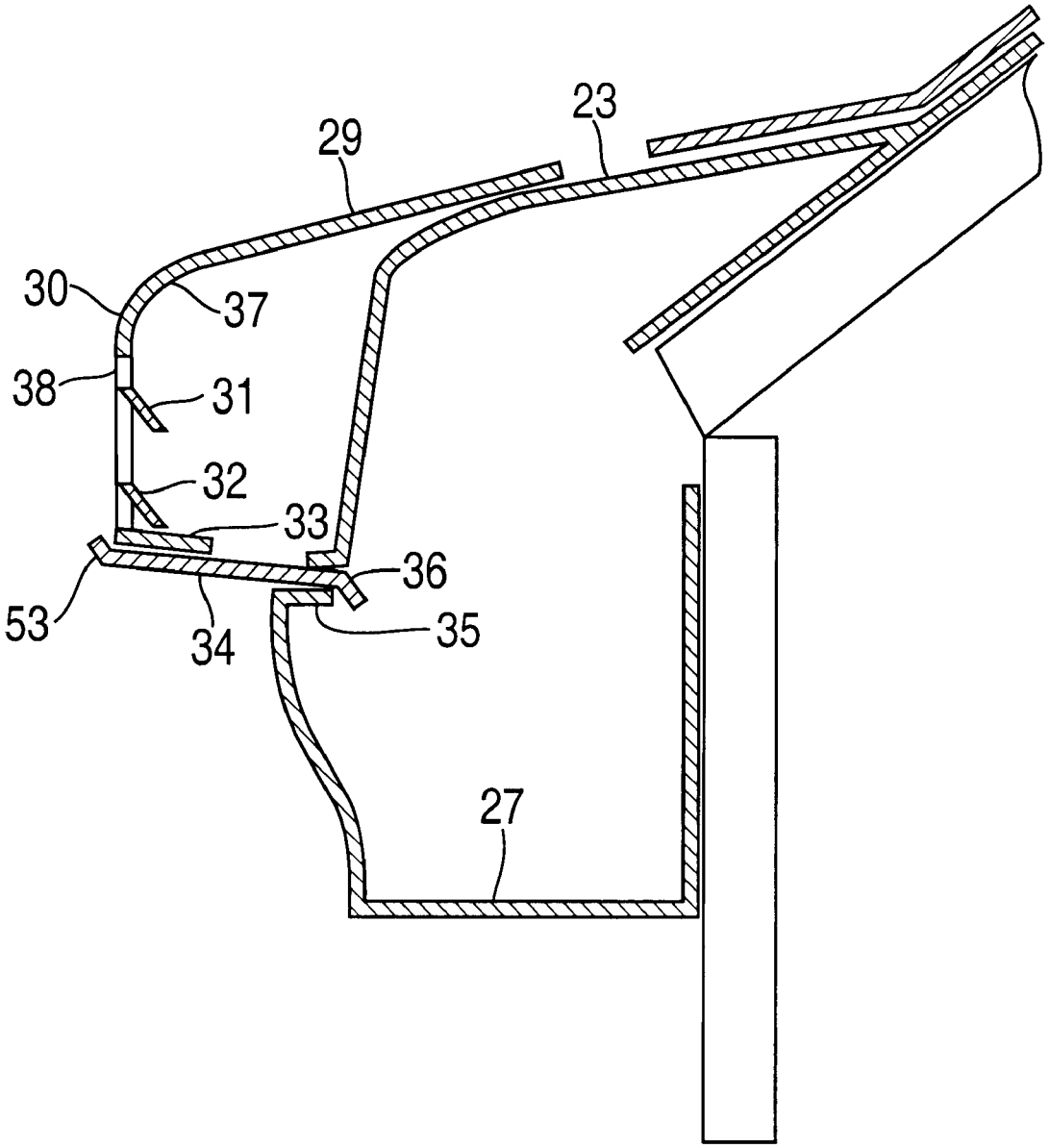
FIG. 12 is a cross sectional detail taken along section line 12—12 of FIG. 10.

Another embodiment of the invention is depicted in FIG. 10, FIG. 11 and FIG. 12. In accordance with the present invention, a water distributor 29 has a top portion 37 fastened to a first rain gutter cover 23 and a second rain gutter cover 24 that are attached to the roof valley 4. The top portion 37 transitions into a vertical section 38 that has at least one aperture (depicted as a first row of apertures 31 and a second row of apertures 32). A generally triangular member 34 is coupled between the vertical section 38 and a rain gutter 27 and a rain gutter 28. The water distributor 29 can be installed in existing roof valley 4 configurations in conjunction with existing rain guttering or gutter covers. The present water distributor 29 additionally can be installed in a manner that does not require fastening devices to be applied to the roofing materials.

Rain water and other debris such as leaves and blossoms flow downward from the two sloped roofs 20 and 21 into the roof valley 4. The rain water flows down the roof valley 4 and onto the tops of two gutter covers (23 and 24) connected together and perpendicular to each other. Water and debris flow onto the top portion 37 of the water distributor 29 leading to a front arcuate portion 30 that transitions to the vertical surface 38 in which there are preferably two rows apertures 31 and 32. The apertures 31 and 32 allow water to flow through the water distributor 29 while being of sufficiently small size such that the debris can not enter.

A bottom flange 33 coupled to the vertical surface 38 of water distributor 29 is attached to the member 34. Water entering the apertures or louvers 31 and 32 of the water distributor 29 is directed by the apertures 31 and 32 onto the member 34. The member 34 is sloped to allow the rain water on the member 34 to flow from the water distributor 29 into the respective gutters 27 and 28. The member 34 has a front flange 53 in which a front edge of the bottom flange 33 of the water distributor 29 is nested. The rear portion of member 34 is fastened with screws, rivets, clips, adhesives or other fasteners (not shown) to an upper front lip 35 of the rain gutter 27 and 28. The rear of the member 34 has a drip edge 36 turned downward and into gutter to direct rain water entering the respective gutter 27 and 28.

Although the present invention is implemented as separate pieces utilizing two rows of apertures (louvers) those skilled in the art will realize that the present invention can be fabricated from one unitary sheet or from individual pieces joined together in various ways known to those skilled in the art. Those skilled in the art will also recognize that gutter covers 23 and 24 can be joined together as one unitary sheet with water distributor 29 integrally built in. Those skilled in the art will additionally be able to substitute other types of water apertures in place of apertures 31 and 32 without deviating from the scope of this invention.

Figure 13:
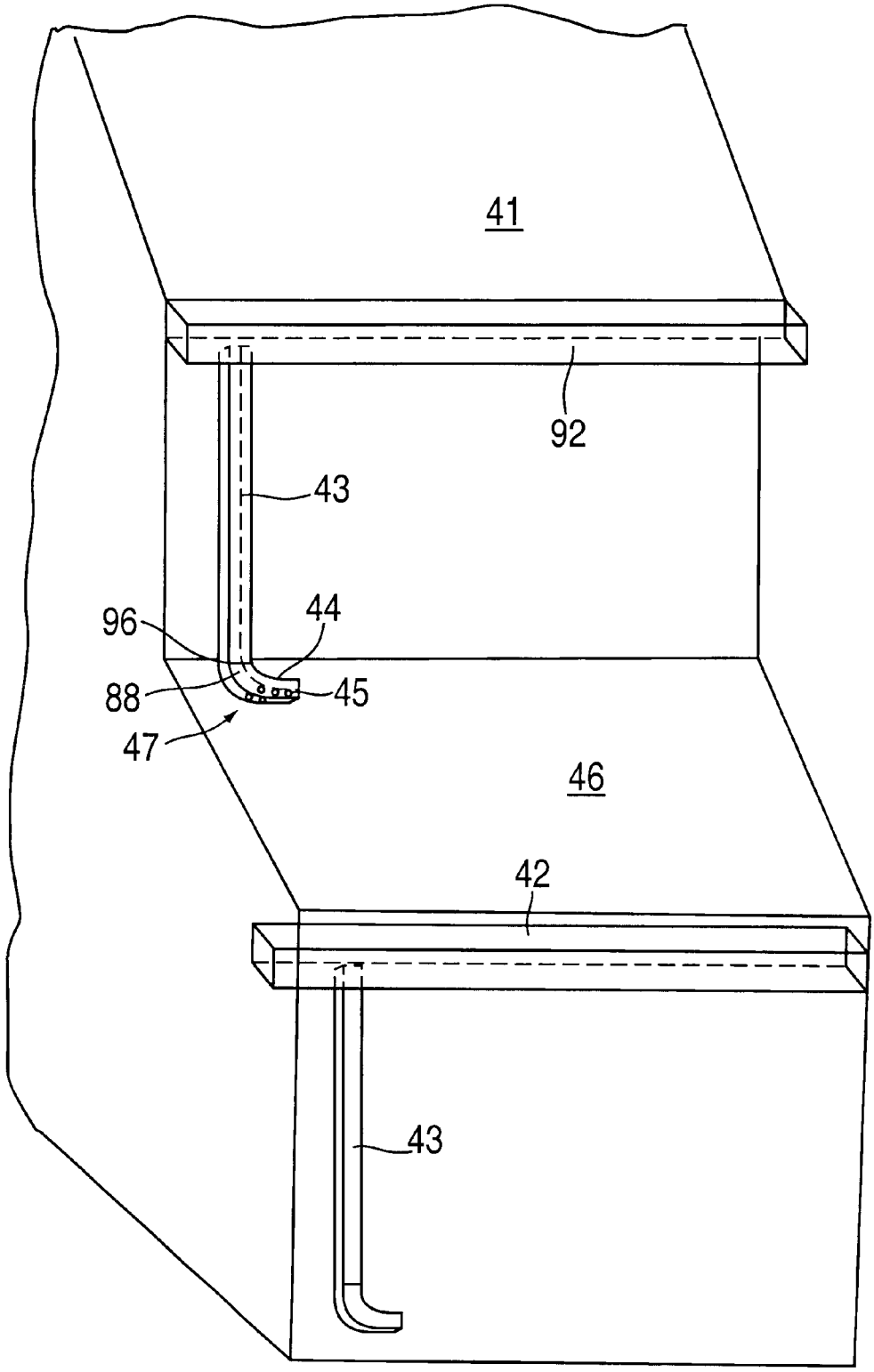
FIG. 13 is a perspective view of another water distributor incorporated into a discharge elbow.
Figure 14:
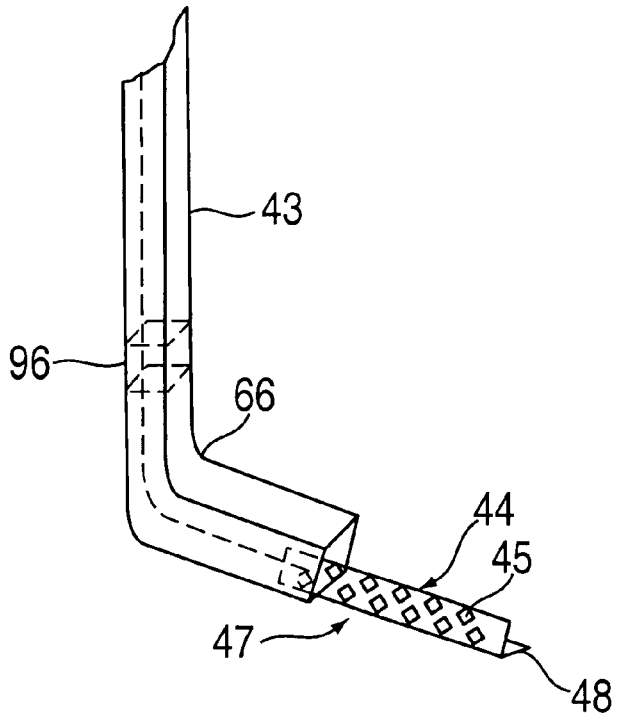
FIG. 14 is a perspective view of another water distributor incorporated into a discharge elbow; and, FIG. 15 is a perspective view of another water distributor incorporated into a discharge elbow.
Figure 15:
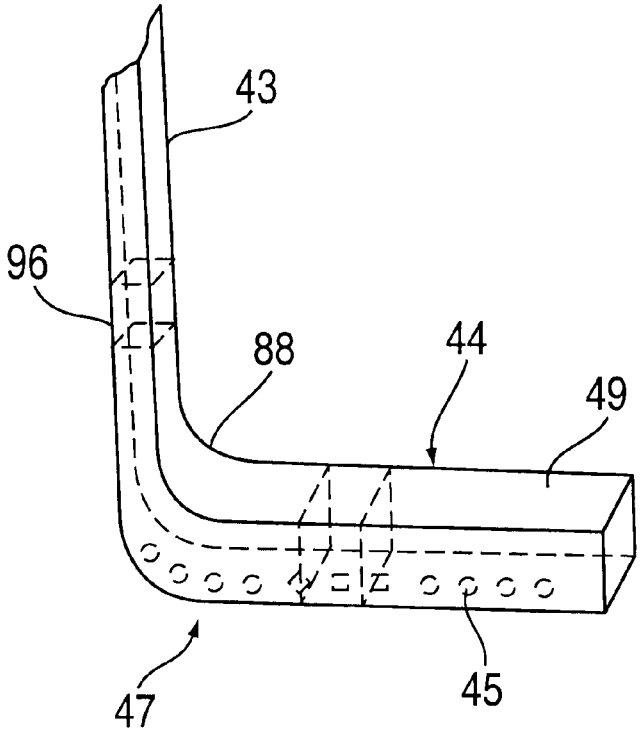

FIG. 13, FIG. 14 and FIG. 15 depict alternate embodiments of the invention. The water distributor 47 directs water from a first roof surface 41 across a second roof surface 46 to a rain gutter 42. Rain water from the first roof surface 41 is channeled though a leader 43 having the water distributor 47 that spreads the rain water exiting the leader 43 across the second roof surface 46. Distributed water flows down the second roof surface 46 and is collected by the rain gutter 42.

The water distributor 47 comprises an end 96 connected to a discharge section 44. The end 96 is configured to mate with conventional leaders 43.

The discharge section 44 has a plurality of holes 45 through which water flowing through the discharge section 44 is spread across the section roof surface 46. The discharge section 44 may have varied configurations. For example, the discharge section 44 may comprise an "L" shaped extension 48. Other examples of configurations for the discharge section 44 include a rectangular extension 49. The discharge section 44 may additionally be incorporated into a discharge elbow 88 wherein the holes 45 are disposed on the discharge elbow 88. The extension 48 and 49 may be coupled a conventional elbow 66 or a discharge elbow 88.

When water from the upper roof 41 is collected in an upper gutter 92 and flows down the leader 43 to the water distributor 47. The openings 45 of water distributor 47 facilitate distributing the water exiting the leader 43 laterally along roof 46. Thus, the water stream exiting the leader 43 is consequently not concentrated in high volume vertical stream when reaching the lower gutter 42. This enables the lower gutter 42 to substantially capture substantially the entire flow of water exiting the leader 43 and distributed by the water distributor 47. Those skilled in the trade recognize that the quantity of openings, their size and shape can be varied while maintaining the utility of the invention. The lower gutter 42 may have screen or gutter cover similar to that shown in FIG. 4. Those skilled in the art will readily recognize that the gutter 42 may be covered with any type of cover or screen or may be in the form of a gutter and water collector all in one.

Although various embodiments which incorporate the teachings of the present invention have been shown and described in detail herein, those skilled in the art can readily devise many other varied embodiments that still incorporate these teachings.

What is claimed is:

1. A water distributor directing water from two adjoining roof surfaces forming a roof valley to a rain gutter, said water distributor comprising:

a gutter cover coupled to at least one of said roof surfaces forming said roof valley;

a substantially triangular top surface bounded by a first edge, a second edge, and a bowed edge; and, at least one flange coupled to said gutter cover and said first edge or second edge, wherein said substantially triangular top surface for spreading water across the substantially triangular top surface away from the roof valley across said bowed edge.

2. The water distributor of claim 1, wherein said bowed edge further comprises:

a front portion.

3. The water distributor of claim 2, wherein said front portion further comprises:

a flange.

4. The water distributor of claim 1 wherein said first edge and said second edge each have a flange.

5. The water distributor of claim 1, wherein said top surface is domed shaped.

6. The water distributor of claim 1, wherein said water distributor is one piece construction.

7. The water distributor of claim 1, wherein said bowed edge further comprises:

a lip.

8. The water distributor of claim 7, wherein said water distributor is one piece construction.

9. The water distributor of claim 7, wherein said lip is flared at an angle between 60 and 120 degrees.

10. A water distributor directing water from two adjoining roof surfaces forming a roof valley to a rain gutter, said water distributor comprising:

a substantially triangular top surface bounded by a first edge, a second edge, and a bowed edge, the first edge and the second edge respectively coupled to the two adjoining roof surfaces that form the roof valley; and, at least one flange coupled to one of said adjoining roof surfaces and said first edge or second edge, wherein said substantially triangular top surface for spreading water across the substantially triangular top surface away from the roof valley across said bowed edge.

11. The water distributor of claim 10, wherein said bowed edge further comprises:

a front portion.

12. The water distributor of claim 11, wherein said front portion further comprises:

a flange.

13. The water distributor of claim 10 wherein said first edge and said second edge each have a flange.

14. The water distributor of claim 10, wherein said top surface is domed shaped.

15. The water distributor of claim 10, wherein said water distributor is one piece construction.

16. The water distributor of claim 10, wherein said bowed edge further comprises:

a lip.

17. The water distributor of claim 16, wherein said lip is flared at an angle between 60 and 120 degrees.

18. The water distributor of claim 16, wherein said water distributor is one piece construction.

* * * * *